United States Patent [19]

Gring et al.

[11] 4,089,609

[45] May 16, 1978

[54] COMBINATION APPLICATOR AND CLOSURE CAP MEANS FOR SHAVING CREAM CONTAINERS

[76] Inventors: Frank M. Gring, 100 Harbor Ave., Marblehead, Mass. 01945; Arthur C. Sordillo, 783 Summer St., West Lynn, Mass. 01905

[21] Appl. No.: 732,954

[22] Filed: Oct. 15, 1976

[51] Int. Cl.[2] ..... A45D 33/02

[52] U.S. Cl. ..... 401/130; 401/207

[58] Field of Search ..... 401/123, 127, 190, 196, 401/204, 205, 130; 222/182, 191; 220/24 R

[56] References Cited

U.S. PATENT DOCUMENTS

| | | | |
|---|---|---|---|
| 3,054,133 | 9/1962 | Hublard et al. | 401/205 |
| 3,333,292 | 8/1967 | Chase et al. | 401/123 |
| 3,355,240 | 11/1967 | Schwartzman | 401/205 |
| 3,390,941 | 7/1968 | Weber | 401/205 |
| 3,618,810 | 11/1971 | Wilson | 222/182 X |
| 3,979,163 | 9/1976 | Beard | 401/190 X |

*Primary Examiner*—Joseph F. Peters, Jr.
*Assistant Examiner*—Norman L. Stack, Jr.

[57] ABSTRACT

An applicator body is combined with an annular supporting base which functions as an applicator handle. The applicator base when not in use as an applicator handle is designed to sealably close the top of a rigid shaving cream container, particularly one of the class in which a pressurized lather is received and discharged from a valve operated nozzle member. The annular applicator base, at its underside, is formed with a closure cap portion and the base and closure cap portion cooperate to snugly engage against concentrically arranged surfaces formed at the container top one above another. The applicator base is further formed at its upper side with a bowl-shaped receptacle in which the applicator body is adhesively secured and in which small amounts of liquid such as water may be contained.

1 Claim, 14 Drawing Figures

COMBINATION APPLICATOR AND CLOSURE CAP MEANS FOR SHAVING CREAM CONTAINERS

BACKGROUND OF THE INVENTION

Shaving cream is commonly packaged and sold in various ways well known to the art. In one form, a collapsible tube is employed from which a lather type cream or a so-called "brushless" cream may be extruded. In another well known form, shaving cream is received in a pressurized rigid container from which small quantities of instant lather may be dispensed by pressing against a valve mechanism in the container.

In the case of both the instant lather as well as the brushless cream, it is customary for a user to receive dispensed lather or cream on the fingers and to manually apply this material to the face so that a uniform layer is spread over the area to be shaved. Such manual application of cream or lather may be objectionable since it entails a further operation of washing away excess cream or lather from the fingers before shaving is undertaken. Also moistening the beard, as is customarily accomplished with a shaving brush and hot water, cannot be carried out as effectively by the manual application of a cream or lather which contains little or no water.

Proposals have been made to provide various forms of applicator means. One such proposal has been to provide a cellulosic sponge element to be attached to the bottom of a pressurized container as disclosed in U.S. Pat. No. 3,333,292. It has also been proposed in U.S. Pat. No. 2,271,589 to combine with a container for cleaning fluid an auxiliary applicator which may be in the form of sponge rubber. Neither of these devices have proven to be practical, and it is believed that there is no combination applicator and container now in use in the trade by means of which manual application of shaving cream or lather can be avoided.

SUMMARIZATION OF THE INVENTION

In the present invention, an improved lather applicator is detachably secured at the upper side of a pressurized type rigid container for instant lather in a convenient position to be removed, receive lather, and apply it to a facial area.

A chief object of the invention is to provide an applicator body which may be readily employed to receive instant lather from a pressurized container and thereafter spread over a facial area to be shaved without using the fingers, thus avoiding the step of washing away excess amounts of lather from the fingers and hand of a user.

It is a further object of the invention to combine with an applicator body a supporting base which may serve as a closure cap for one standard form of instant lather container construction now widely employed by most manufacturers.

A further object of the invention is to devise a combination applicator and closure cap which, when mounted at the top of a standard form of instant lather container, may be housed in a transparent enclosure for customer viewing.

Still another object is the provision of an applicator sponge body, preferably of hydrophilic nature, mounted in a supporting base which not only serves as a handle for holding the applicator, but is also formed with a bowl-shaped receptacle in which small quantities of liquid material such as water may be held and released through the hydrophilic applicator body.

The nature of the invention and its other objects and novel features will be more fully understood and appreciated from the following description of a preferred embodiment of the invention selected for purposes of illustration and shown in the accompanying drawings.

DETAILED DESCRIPTION OF THE INVENTION

Figure 1:
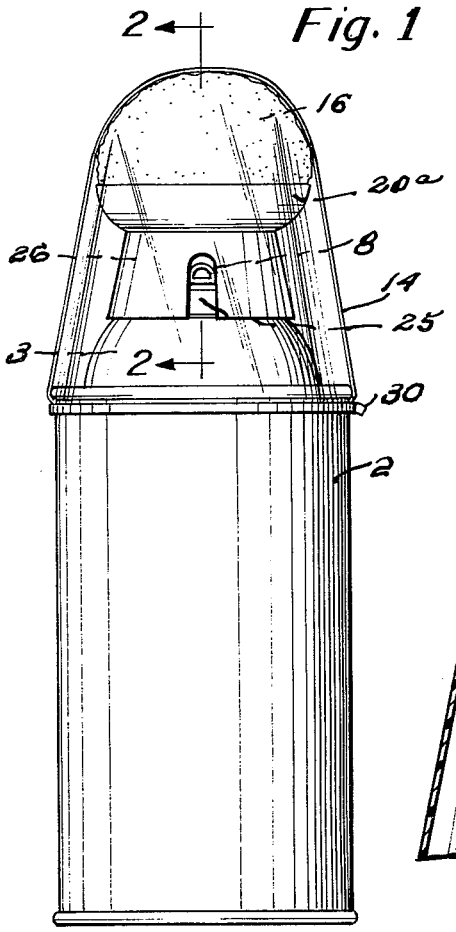
FIG. 1 is a side elevational view of one standard form of instant lather container with the applicator and closure cap means of the invention mounted thereon.
Figure 2:
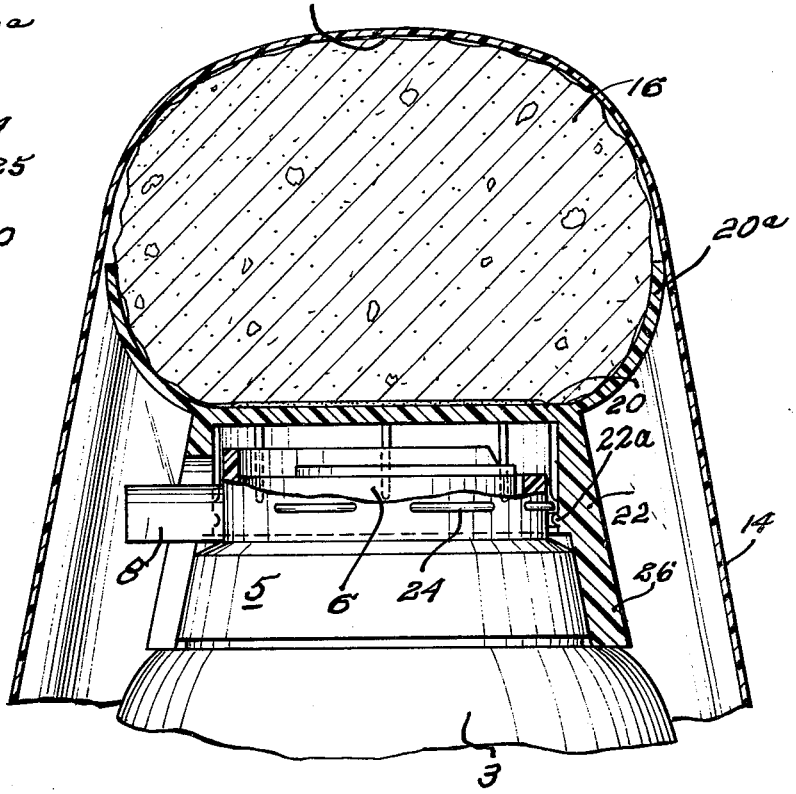
FIG. 2 is a fragmentary cross section taken on the line 2—2 of FIG. 1.

In FIGS. 1 to 5, one preferred embodiment of the invention has been illustrated, and as shown therein, numeral 2 denotes a rigid shaving cream container which, preferably, is of the type employed in containing a pressurized instant lather. A standard form of pressurized container which is presently being made and sold by most of the shaving cream companies consists in a cylindrical member, the upper end of which is formed with a rounded section 3. Extending upwardly from the rounded section 3 is a rim 5 which is further formed with an annular nozzle-retaining head 6 of reduced diameter. The nozzle retaining head supports a nozzle 8 projecting laterally therefrom, as shown in FIG. 2. With this conventional container, it is pointed out that it is further customary to utilize a cylindrical cover which completely encloses the nozzle apparatus described.

Yieldably secured in spaced relation to the annular nozzle retaining body is a valve actuator 10 which is connected to the nozzle 8 by a small passageway 12.

Depressing the valve actuator opens valve means of conventional construction to release pressurized shaving cream through the nozzle 8 in the well known manner.

In the present invention, the use of a cylindrical cover is eliminated and in place thereof is provided a closure device which includes an applicator body for receiving shaving cream and applying it to a facial area to be shaved. Both the closure device and the applicator body are preferably enclosed in a transparent cover 14 which permits customer viewing of the applicator when the container is on a sales shelf, and which may readily be detached when the applicator is to be used.

Considering these parts in further detail, numeral 16 denotes an applicator body which, in a preferred form, may consist of a sponge material, and in particular, a hydrophilic sponge material such as is obtained from a plant-like sea growth. Other types of cellulose materials such as plastic and rubber may also be utilized.

Figure 5:
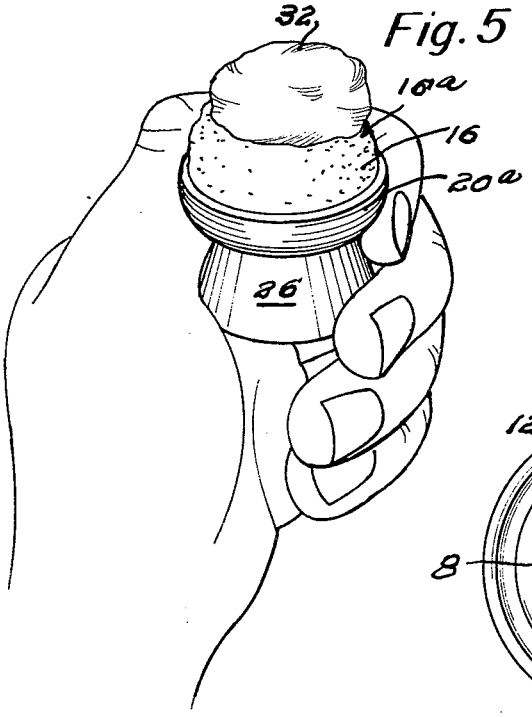
FIG. 5 is a diagrammatic view illustrating the applicator body manually held in a position to receive lather, with a quantity of lather thereon in readiness to be spread over a facial area to be shaved.
Figure 3:
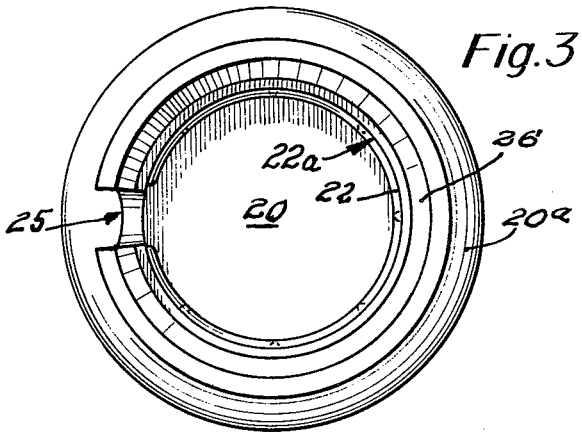
FIG. 3 is a bottom plan view of the applicator and closure cap means.
Figure 4:
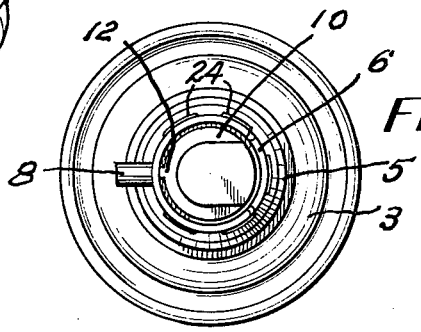
FIG. 4 is a plan view illustrating a standard form of instant lather container construction widely used in the trade.

The applicator 16 may be formed with a rounded upper surface **16*a* which is of a size and shape suitable for receiving a small quantity of instant lather or other type of shaving cream as suggested in FIG. 5**.

In the preferred embodiment of applicator shown in FIGS. 1 to 5, there is combined with the applicator 16 a supporting base 20 which may be made of plastic, rubber and the like and which may be attached to the applicator by adhesive or other suitable fastening means. At its upper side, the supporting base 20 is recessed to define an annular closure cap part 22 made of a size and shape such that an annular rib **22*a* it may be snugly fitted around the annular nozzle retaining head 6 and be releasably held by lug portions 24, formed in the outer surface of the retaining head 6**.

The supporting base is further formed with an annular handle portion 26 extending downwardly from the cap part 22 as shown in FIG. 2 and being of a size to slidably engage around the circular rim 5 of the container and seat firmly along its bottom edge against the container section 3, as is most clearly shown in FIG. 2. The handle portion is formed with a slot 25 for engaging around the nozzle 8.

At its upper side, the supporting base 20 is constructed with a bowl-shaped receptacle portion **20*a* which serves in the dual capacity of supporting the bottom of the sponge body 16** and also constituting a means for containing small amounts of water which can be forced outwardly when the sponge member is pressed against a facial area.

In utilizing the shaving cream apparatus of the invention, the translucent cover 14 is first removed by means of a tear strip **30*b* in FIG. 1. Thereafter, the applicator body is lifted up and the closure cap part and handle 26 is disengaged from adjacent surfaces of the container member and held under a hot water faucet to thoroughly moisten the sponge material and to provide for a small quantity of water accumulating in the bowl-shaped receptacle 20*a*. The moist sponge applicator is used to apply hot water to the facial area to be shaved, and thereafter shaving cream is discharged from the nozzle 8 by pressing against the actuator part 20 in the container and a quantity of shaving cream 32 is allowed to collect on the top of the sponge applicator 16 as indicated diagrammatically in FIG. 5. The applicator may then be employed to spread the shaving cream over the area to be shaved with the handle part 26** being employed to hold the applicator member.

Figure 6:
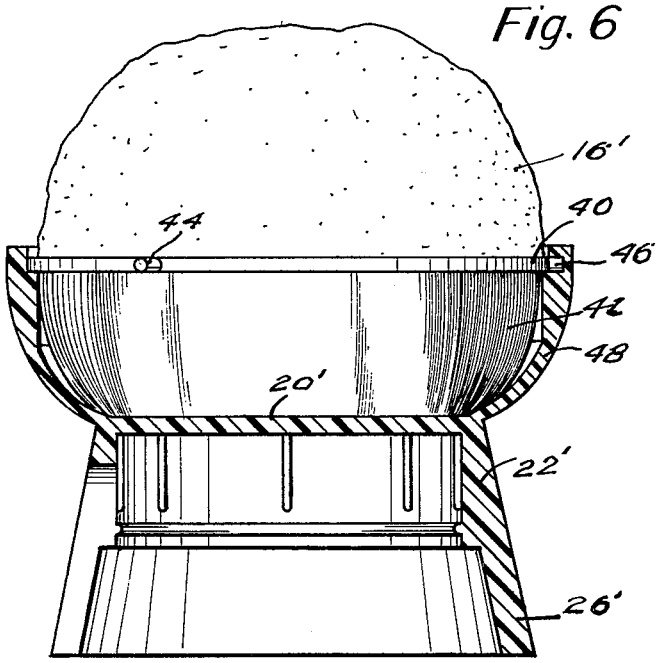
FIG. 6 is a cross sectional view illustrating amodified form of applicator in which both brush means and sponge means are interchangeably supported in a bowl-shaped receptacle portion of the applicator base.
Figure 7:
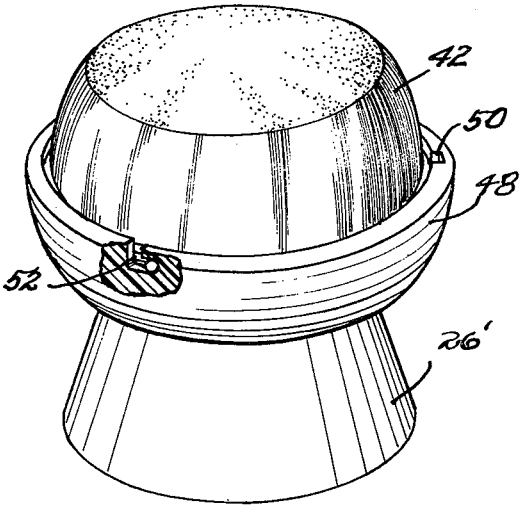
FIG. 7 is a perspective view of the structure shown in FIG. 6 but illustrating the brush means mounted in an exposed position at the top of the bowl-shaped receptacle.

In FIGS. 6 and 7 a modification of the invention is illustrated in which a sponge applicator 16' is mounted in a supporting base 20' having an internally recessed cap portion 22' and a depending handle portion 26' of the same general construction already described. The applicator 16' is secured to a thin circular wall portion 40 and at the underside of the wall portion 40 is adhesively attached a brush member 42 composed of bristles of the class commonly utilized in shaving brushes. The outer perpheral edge of the wall portion 40 is provided with projecting pins as 44 and 46, and the supporting base 20' has its upper side formed with a bowl-shaped receptacle 48 in which are slots as 50 and 52 of the bayonet joint type in which the pins 44 and 46 may be detachably secured as is more clearly shown in FIG. 7.

By means of the dual applicator arrangement described, the user may, at will, employ either a brush or a sponge to apply hot water collected in the sponge or brush, as well as in the bowl-shaped receptacle 48. Thereafter, the applicator in either a brush or sponge form may be held to receive shaving cream and apply the shaving cream in the manner already described.

In FIGS. 8 to 11, there has been illustrated another modification of the invention in which an applicator body preferably of sponge material is permanently secured to a shaving cream container in a manner such that shaving cream may be discharged from the container into the sponge material and thereafter transferred to a facial area. It is contemplated that in this arrangement of parts, the container body may be of a relatively small size suitable for being held in the hand in much the same manner as would be the case with a brush handle.

Figure 8:
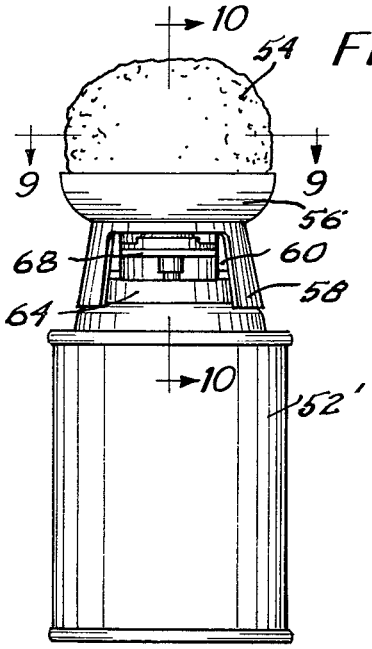
FIG. 8 is a side elevational view of still another modification of the invention illustrating a combination applicator and closure cap means.
Figure 9:
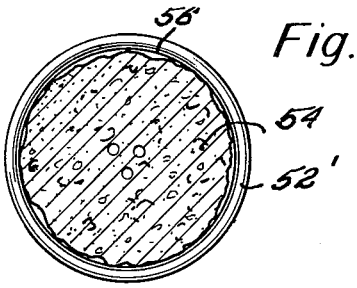
FIG. 9 is a cross section taken on the line 9—9 of FIG. 8.

In FIG. 8, numeral 52' denotes a container of the type already described and being of rigid construction for holding a pressurized shaving cream. Numeral 54' refers to a sponge applicator body which is received in a supporting base, the upper side of which is formed with a bowl-shaped receptacle 56 and the lower portion of said base being constructed with an annular handle portion 58 which is cut away along a portion of its lower edge to provide an opening 60.

The handle portion 58 is firmly secured around an annular closure cap portion 62 which, in turn, is fitted around a nozzle retaining part 64 in which is vertically disposed a nozzle 66. The nozzle 66 is tiltable out of its normally vertically disposed position to open a valve mechanism of conventional nature, and thus release of shaving cream from the container may be carried out.

Figure 10:
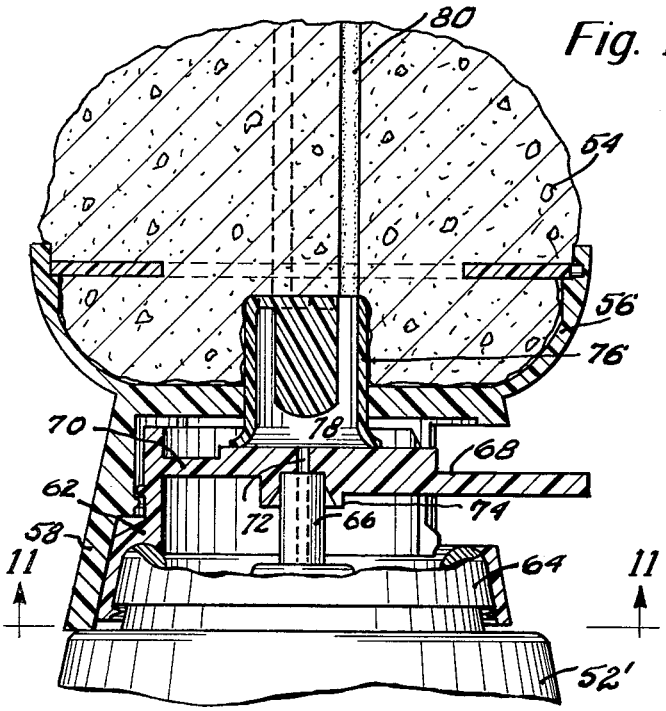
FIG. 10 is a cross section taken on the line 10—10 of FIG. 8.
Figure 11:
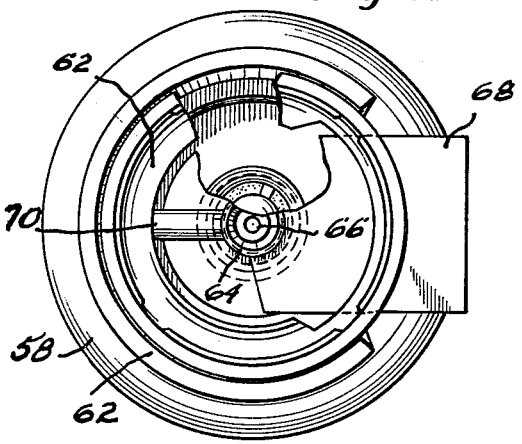
FIG. 11 is a cross sextion taken on the line 11—11 of FIG. 10.

In combination with the tiltable nozzle 66 there is provided actuator means for manually moving the nozzle 66 into a discharge position. This includes an actuator element 68 which has an inner circular part arranged in spaced relation to the closure cap part 62 and being flexibly connected to part 62 at one point by a narrow web portion 70. The actuator element extends outwardly through the opening 60 in a position such that it may be manually contacted and pressed downwardly. The actuator element is further provided with a central passageway 72 communicating with a tubular fitting 74 sealably engaged around the nozzle 66 as shown in FIG. 10. At the upper side of the actuator element 68 is a connector 76 arranged to project upwardly into the sponge applicator 58 in which are formed openings as 78, positioned to register with the vertically disposed passageways, as 80, formed in the sponge applicator.

In this modification of the invention, the container body 52' is employed as a handle in applying shaving cream. Finger pressure against the actuator 68 tilts the nozzle 66 into an open position and pressurized shaving cream flows through the passageway 72 along the openings 76 and upwardly of the applicator 54 out of the passageway 80.

in a preferred procedure, the sponge applicator 54 is moistened with warm water and the warm water is first applied to the face. Thereafter, with a small quantity of warm water collected in the cup-shaped receptacle 56, shaving cream is released and spread over a facial area, while at the same time, conducting small amounts of water through the sponge applicator with the shaving cream.

Figure 12:
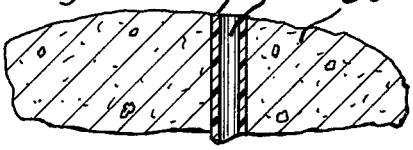
FIG. 12 is a fragmentary detail view illustrating a modified form of applicator body.

In FIG. 12, there has been shown an applicator body 55 having a passageway as 57 comprised by a tubular body 59. Various other modifications of passageways may be resorted to.

Figure 13:
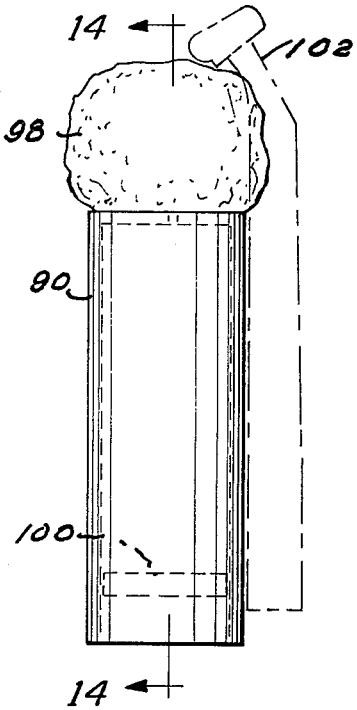
FIG. 13 is an elevational view of still another modification of the invention.
Figure 14:
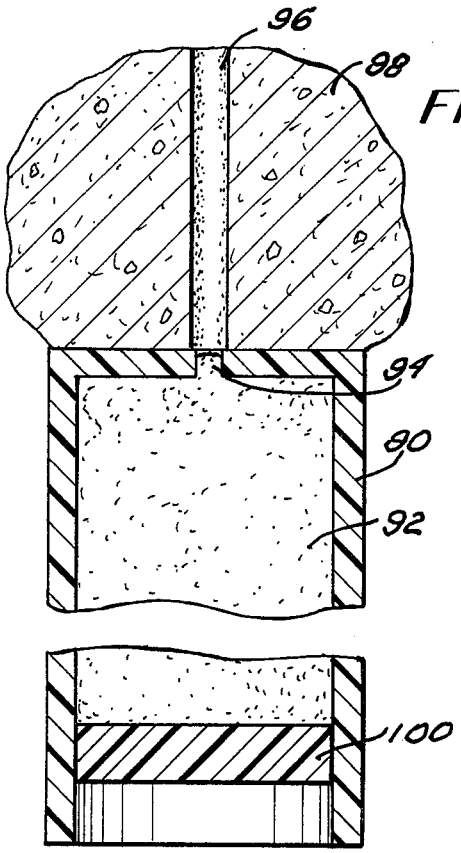
FIG. 14 is a cross section taken on the line 14—14 of FIG. 13.

The combination of a shaving cream container with a sponge applicator permanently attached thereto may also be arranged in the manner illustrated in FIGS. 13 and 14 wherein a container 90 holds a quantity of shaving cream which may be of a brushless type and which can be expelled through an opening 94 along a passageway 96 in a sponge applicator 98, permanently attached at the top of the container 90. Small quantities of the brushless cream may be forced upwardly and out of the applicator body by applying pressure to a piston 100.

The invention described may be conveniently arranged to provide a disposable unit wherein relatively small quantities of shaving cream are utilized, and in some cases, the applicator assembly may be used one or two times and then discarded. It may also be desired to combine with a disposable shaving cream and applicator kit a disposable razor unit 102, detachably secured along one side of the container body.

We claim:

1. In combination a cylindrical container for holding a pressurized shaving cream and dispensing shaving cream onto fingers of a user, said container being formed with an annular shoulder portion extending around the outer side thereof and terminating in a cylindrical rim presenting outwardly projecting spaced apart lug portions, a dispensing nozzle extending laterally outwardly from the rim, a valve actuating member movable inside the rim to release pressurized lather, a cylindrical cap and applicator device for receiving discharged shaving cream and holding the discharged shaving cream out of contact with the fingers of a user, said cylindrical cap device being internally recessed to provide a cylindrical wall fitted around the said rim, said cylindrical wall being formed with an outwardly projecting annular rib portion located in a position to engage beneath the lug portions and detachably secure the cap device on the container, the lower side of the cap device being extended downwardly to form an annular handle which is engageable with an outer portion of the said annular shoulder to protectively house the valve actuating member, a portion of the handle being recessed to form a slot through which the dispensing nozzle is received, the upper side of the cap device being formed with a bowl-shaped liquid receptacle, a hydrophilic applicator body secured in the receptacle for receiving pressurized cream from the container when the handle is detached therefrom and said bowl-shaped receptacle being operative to receive and hold liquid during a shaving operation and to prevent discharge of liquid from the applicator after the applicator has been used and the cap device is re-engaged with the container.

* * * * *